US010174747B2

(12) United States Patent
Lilie et al.

(10) Patent No.: US 10,174,747 B2
(45) Date of Patent: Jan. 8, 2019

(54) SEMI-COMMANDED VALVE SYSTEM APPLIED TO COMPRESSOR AND METHOD FOR MODULATING THE CAPACITY OF A COMPRESSOR PROVIDED WITH A SEMI-COMMANDED VALVE SYSTEM

(71) Applicant: WHIRLPOOL S.A., São Paulo (BR)

(72) Inventors: Dietmar Erich Bernhard Lilie, Joinville (BR); Eduardo Arceno, Joinville (BR); Rodrigo Kremer, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 398 days.

(21) Appl. No.: 14/369,054

(22) PCT Filed: Nov. 28, 2012

(86) PCT No.: PCT/BR2012/000487
§ 371 (c)(1),
(2) Date: Jun. 26, 2014

(87) PCT Pub. No.: WO2013/097006
PCT Pub. Date: Jul. 4, 2013

(65) Prior Publication Data

US 2014/0377082 A1 Dec. 25, 2014

(30) Foreign Application Priority Data

Dec. 26, 2011 (BR) ..... 1105379

(51) Int. Cl.
*F04B 7/00* (2006.01)
*F04B 39/08* (2006.01)
*F04B 39/10* (2006.01)

(52) U.S. Cl.
CPC ..... *F04B 7/0076* (2013.01); *F04B 39/08* (2013.01); *F04B 39/1073* (2013.01)

(58) Field of Classification Search
CPC ..... F04B 7/0076; F04B 39/1066; F04B 53/1082; F16K 15/18; F16K 99/0046
See application file for complete search history.

(56) References Cited

U.S. PATENT DOCUMENTS 3,844,686 A 10/1974 Le Blanc
2007/0272178 A1 11/2007 Brun et al.
(Continued)

FOREIGN PATENT DOCUMENTS

DE 102004018567 B3 12/2005
EP 1338794 A1 * 8/2003 ..... F04B 7/0076

OTHER PUBLICATIONS

International Search Report issued in PCT/BR2012/000487 dated Feb. 20, 2013.

*Primary Examiner* — Kenneth J Hansen
(74) *Attorney, Agent, or Firm* — Harrington & Smith

(57) ABSTRACT

Semi-commanded valve system applied to an alternative-type compressor with at least a cylinder (1), at least a piston (2), at least a compression chamber (3), and at least one valve (71;81) acting in their respective orifice (7;8). Said at least one valve (71;81) is prestressed in a first operation state and is able to act as a check valve. Furthermore, said at least one valve (71;81) has at least a ferrous portion and can be selectively actuated by a magnetic field generating element (72;82). Method of modulating the capacity of a compressor provided with such a semi-commanded valve system.

12 Claims, 1 Drawing Sheet

(56) References Cited

U.S. PATENT DOCUMENTS

| | | | | |
|---|---|---|---|---|
| 2010/0043887 | A1 | 2/2010 | Oddie | |
| 2010/0143171 | A1* | 6/2010 | Gaumnitz | F04B 7/0076 417/505 |

* cited by examiner

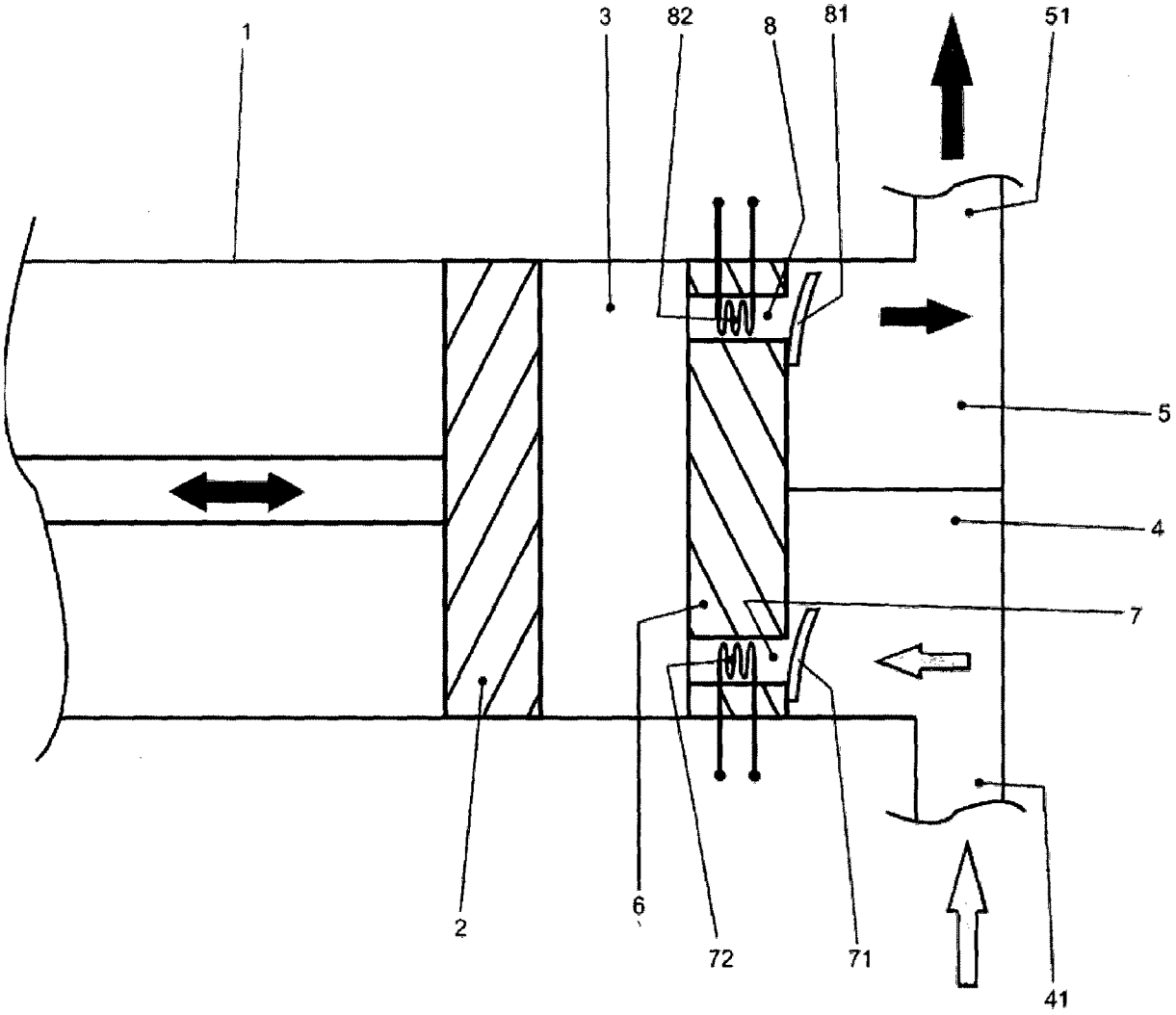
51
81
8
82
3
1
5
4
7
41
71
72
6
2

SEMI-COMMANDED VALVE SYSTEM APPLIED TO COMPRESSOR AND METHOD FOR MODULATING THE CAPACITY OF A COMPRESSOR PROVIDED WITH A SEMI-COMMANDED VALVE SYSTEM

RELATED APPLICATIONS

The subject application is a U.S. National Stage Application of International Application No. PCT/BR2012/000487, filed on Nov. 28, 2012, which claims the priority of Brazil Patent Application No.:PI1105379-8, filed on Dec. 26, 2011, the contents of which are herein incorporated by reference in its entirety.

FIELD OF THE INVENTION

The present invention refers to a semi-commanded valve system applied to alternative compressor, and a method for modulating a compressor provided with the semi-commanded valve system.

Generally speaking, the present invention provides means for manipulating the forced opening and closing of suction valves and/or discharge valves of alternative compressors. By manipulating these valves it is also possible to control the capacity of an alternative compressor with fixed speed.

BACKGROUND OF THE INVENTION

With regard to conventional alternative compressor assemblies

It is already known from those skilled in the art that alternative compressors comprise machines and/or devices capable of altering the pressure of a working fluid as well as pumping it. In this sense, and in a more specific form, alternative compressors are capable of altering the pressure of a working fluid by controllably altering the volume of a compression chamber that is usually defined by a cylindrical chamber that is able to receive the working fluid and a movable piston. Therefore, due to the displacement of the movable piston occurring inside the compression chamber the volume thereof is alternatively (decreased and increased) altered.

Additionally, it is also known from those skilled in the art that the inlet (suction) and removal (exhaustion) steps of the working fluid inside the compression chamber consist of critical steps to achieve a current functioning of an alternative compressor. Furthermore, said steps directly impact the parameters of a compressor performance, and, for this reason, the current state of the art comprises a great number of valve systems intended to control suction and discharge of working fluid inside the compression chamber.

In accordance with the conventional functioning of a state-of-the-art valve system, it is observed that conventional suction valves have a normal closed configuration, and their automatic and uncommanded "opening" uniquely and exclusively occurs when the piston is at the superior dead point and descends to the lower dead point, that is, the current suction valves can only be kept "open" when the pressure inside the cylinder drops to a value that is lower than the pressure in the suction chamber.

Such an operability of the current suction valves, although functional, can be further improved since as it can be observed it is necessary to generate a favorable pressure difference such that they can "open" and in this connection, in addition to a higher starting force for the electric motor that moves the piston, a greater energy loss for pumping the fluid is required. Conventional solutions provide for an oversizing of this motor (to allow for it to "start" the compressor), ou also the use of complex and expensive specific starting systems.

Concerning conventional discharge valves, they also have a normal-closed configuration, and their automatic and uncommanded "opening" uniquely and exclusively occurs when the piston travels from the lower dead point and goes towards the superior dead point, thereby increasing the pressure inside the cylinder, i.e. when the pressure inside the cylinder is higher than the pressure in the discharge chamber.

Such operability of the current charge valves although also functional prevents any sort of capacity modulation of the compressor in conjunction with the maintenance of the motor speed.

With regard to the current alternatives of capacity modulation of compressors

According to the widely spread state-of-the-art understanding, it is known that only compressors with variable speed are able to change an operation speed, thereby modulating the capacity thereof while the so-called ON-OFF computers do not have this advantage.

In the case of the cited compressors with variable speed, which are based on continuous current (VCC) electrical motors, it can be observed that as the compressor reduces its operation speed the lower is the gas mass displaced into any system (such as, for example, refrigeration systems), and, consequently, elevated gains of effectiveness increase in systems demanding varying gas masses can be obtained.

Current compressors with varying speed use a complex electronics in association with a permanent-magnet motor, and, generally, this association of magnets with electronics has high costs. Another limitation of such compressors refer to a minimum speed at which it can operate since this minimal rotation value is also directly connected with the compressor reliability.

Further, as a palliative alternative to the capacity modulation of compressors, the current state of the art provides certain solutions where suction and/or discharge orifices of a valve plate can have their diameter relatively altered (partially obstructed) during their respective functional step.

U.S. Pat. No. 3,844,686 and US Patent Application 2010/004387 disclose, for example, electromagnetic mechanisms capable of directly or indirectly promoting decrease/increase in the suction and/or discharge diameter; nevertheless, such mechanisms only have relevant operability when suction or discharge valves are operationally "opened."

Based on the above explained context, it can be clearly noted that the current state of the art concerning valve systems of alternative compressors essentially relies on non-flexible and non-customizable equivalent operational principles.

Furthermore, it is also noted that the current state of the art relative to means for modulating the capacity of alternative compressors refers to not entirely applicable solutions, or also to expensive solutions which are not applied to more ordinary applications.

Based on this scenario the present patent of invention was developed.

OBJECTS OF THE INVENTION

Hence, one object of the present invention is to provide for a valve system for alternative compressor capable of being semi-commanded at any time during the operational compression cycle. Hence, another object of the present invention is to make with which said now disclosed valve system allows for selective manipulation of the suction valve and/or the exhaustion valve.

Another object of the present invention is to provide for a method for modulating the capacity of the compressor by selectively switching said suction valve and/or the exhaustion valve. In this regard, a further object of the present invention is to provide for a method for modulating the capacity by refluxing working fluid.

Additionally, one of the objects of the present invention is to provide a method for modulating the capacity, wherein said method will also help to start the compressor motor.

Finally, another object of the present invention is to provide for a less expensive and more functional solution than those solutions for analogous purposes known from the current state of the art.

SUMMARY OF THE INVENTION

These and other objects are entirely accomplished by means of a semi-commanded valve system applied to alternative-type compressor (of the kind comprising at least a cylinder, at least a piston, at least a compression chamber and at least a valve acting in its respective orifice). The system itself comprises at least a valve (which comprises a prestressed mechanical valve in a first operational state, and comprising at least a ferrous portion) and at least a selectively actuated magnetic field generating element. According to the present invention, the operational state of said at least a valve is selectively switched by actuating said at least a magnetic field generating element.

Preferably, the operational state of at least a valve is selectively switched between a first operational state and a second operational state by means of a magnetic pulse of the magnetic field generating element. In this sense, and in a preferred form, the first operational state of the valve is randomly designated as a "opened" state, and the second operational state of the valve as a "closed" state.

It is worth to mention here that, in accordance with the present invention, the valve can comprise a suction valve, or further, a discharge valve. With regard to the magnetic field generating element, same comprises an electric coil or the like. In a further preferred mode, at least a valve and its respective magnetic field generating element are disposed on at least one valve plaque and in the case of more than one semi-commanded valve in accordance with the concepts hitherto disclosed, a magnetic insulation between the valves is provided.

The above-mentioned objects are also achieved in function of the method for modulating the capacity of a compressor provided with a semi-commanded valve system, which includes refluxing suction and/or exhaustion by means of non-spontaneous switching of at least one valve.

In this sense, spontaneous closing of at least one valve can be delayed, or, additionally, spontaneous opening of at least one valve is delayed.

Preferably, there is a delay in the spontaneous closing of the suction valve and a delay in the spontaneous opening of the discharge valve.

BRIEF DESCRIPTION OF THE FIGURES

The conceptual embodiment of the presently disclosed semi-commanded valve system applied to an alternative compressor will be described in detail based on FIGURE mentioned below, wherein:

FIG. 1 illustrates a schematic model of a functional mechanism of an alternative compressor provided with the presently disclosed semi-commanded valve system.

DETAILED DESCRIPTION OF THE INVENTION

In accordance with the present invention and in order to achieve the objects mentioned above, a novel semi-commanded valve system applied to an alternative-type compressor is disclosed.

Generally, said system comprises at least a prestressed valve in a first operational state, and at least a ferrous portion, and at least a selectively actionable magnetic field generating element. By this way, the operational state of said at least a valve can be being selectively switched by actuating at least one magnetic field generating element.

In accordance with the conceptual embodiment illustrated in FIG. 1, it can be noted that the presently disclosed system uses devices having electric coils 72, 82 and prestressed valves 71, 81 in an opened state. Said valve remains opened due to the prestress, and said electric valve has the function of generating a magnetic field thereby favoring closing of the valve.

According this essential concept, said features can be applied to a suction valve 71 and/or a discharge valve 81.

The prestressed valves are positioned in alignment with their respective electric coils such that when activated they are in condition to generate a magnetic field thereby attracting its prestressed valve to the direction of the valve plate 6 aiming at sealing orifices 7, 8 (suction orifice and discharge orifice, respectively).

Hence, it is possible to modulate the capacity of the compressor with no need to vary the operational speed of its electric motor (not shown). By doing so, it is possible to control the mass amount passing through said suction orifice 7 and said discharge orifice 8 so as to obtain the desired functional capacity to increase the effectiveness of any system and, more specifically, a refrigeration system.

When in operation, the presently claimed system can cause the suction valve 71 and/or the discharge valve 81 to close at any time during the cycle of piston 2 (having an alternative displacement within cylinder 1), thus increasing or decreasing the volume of the compression chamber 3). There is also an option of not closing the valves. Therefore, it is possible to obtain alterations in the time of intently closing said valves to generate determined refluxes in the suction chambers 4 and/or discharge chamber 5 and, consequently, a capacity modulation will occur due to the fact that the amount of working fluid delivered to the system using an alternative compressor (preferably a refrigeration system) has been altered.

The system in accordance with the present invention has the advantage of prematurely opening the suction valve, since same is with the opening prestress. Such an advantage represents a reduction in the pressure to open the suction valve and, as a result, less energy will be consumed by the compressor. Furthermore, the suction valve will close at the time the electric coil is actuated or when the valve with prestress meets a pressure gradient favorable to closing. Hence, it is possible to alter the refrigeration gas flow that will be delivered to the refrigeration system by modulating the reflux in the suction valve.

This same concept can be applied to the discharge valve wherein when the piston starts from the lower dead point and travels towards to the superior dead point, pressure within the cylinder increases until it becomes higher than the pressure in the discharge chamber, and, at this time, the discharge valve will begin an opening movement, which is facilitated by the prestress of said valve. When the piston discharges the gas to the outside the cylinder and process of returning to the lower dead point begins, and the valve with prestress will remain opened to allow for the gas of the discharge chamber to return into the cylinder. This reflux will stop when the electric coil is driven, thereby closing said discharge valve. Said reflux represents the gas that has not been delivered to the system and allowed for a capacity modulation to occur.

Further, it is important to mention that actuation of the coils can be effected by simple electronics supplying sufficient electric current to generate a magnetic field and to close the valves.

After an exemplary embodiment of the present invention has been described, it should be construed that the scope thereof encompasses other possible variations, which are only limited by the contents of the appended claims, including possible equivalent means.

The invention claimed is:

1. A semi-commanded valve system applied to a compressor, wherein the compressor comprises at least a cylinder, at least a piston, at least a compression-chamber, and at least one prestressed valve acting in a respective orifice, the semi-commanded valve system comprising:

the at least one prestressed valve in an open operational state, and comprising at least a ferrous portion; and at least one selectively actuated magnetic field generating element aligned with the at least one prestressed valve;

wherein the open operational state of the at least one prestressed valve is configured to be selectively switched by actuating the at least one selectively actuated magnetic field generating element, wherein the at least one selectively actuated magnetic field generating element, when activated, is configured to attract the at least one prestressed valve towards the at least one selectively actuated magnetic field generating element based upon the alignment to put the at least one prestressed valve in a closed operational state;

wherein when the piston starts from a lower dead point and travels towards to a superior dead point, pressure within the cylinder increases until it becomes higher than a pressure in a discharge chamber, and, at this time, the at least one prestressed valve begins an opening movement, which is facilitated by open prestress of said at least one prestressed valve;

wherein when the piston discharges a gas to an outside of the cylinder, a return to the lower dead point begins, and the at least one prestressed valve with open prestress remains opened to allow for the gas of the discharge chamber to return into the cylinder; and wherein this return of gas of the discharge chamber into the cylinder stops when the at least one selectively actuated magnetic field generating element is driven, thereby closing said at least one prestressed valve.

2. The semi-commanded valve system, in accordance with claim 1, wherein the at least one prestressed valve is configured to be selectively switched between the open operational state and the closed operational state using at least one magnetic pulse of the at least one selectively actuated magnetic field generating element.

3. The semi-commanded valve system, in accordance with claim 2, wherein the open operational state of the at least one prestressed valve opens the respective orifice.

4. The semi-commanded valve system, in accordance with claim 2, wherein the closed operational state of the at least one prestressed valve closes the respective orifice.

5. The semi-commanded valve system, in accordance with claim 1, wherein the at least one prestressed valve comprises a suction valve.

6. The semi-commanded valve system, in accordance with claim 1, wherein the at least one prestressed valve comprises a discharge valve.

7. The semi-commanded valve system, in accordance with claim 1, wherein the at least one selectively actuated magnetic field generating element comprises an electric coil.

8. The semi-commanded valve system, in accordance with claim 1, wherein the at least one prestressed valve and a respective selectively actuated magnetic field generating element of the at least one selectively actuated magnetic field generating element are disposed on at least a valve plate.

9. The semi-commanded valve system, in accordance with claim 1, wherein the at least one prestressed valve includes two prestressed valves, and wherein a magnetic insulation is provided between the two prestressed valves.

10. A method for modulating the capacity of the compressor provided with the semi-commanded valve system as defined in claim 1, comprising refluxing at least one of suction and exhaustion by non-spontaneous switching of the at least one prestressed valve.

11. The method, in accordance with claim 10, further comprising delaying spontaneous closing of the at least one prestressed valve.

12. The method, in accordance with claim 10, further comprising delaying spontaneous opening of the at least one prestressed valve.

* * * * *